US005496673A

United States Patent [19]

Saitoh et al.

[11] Patent Number: 5,496,673

[45] Date of Patent: Mar. 5, 1996

[54] CARRIER FOR DEVELOPER OF ELECTROSTATIC LATENT IMAGES

[75] Inventors: Tsutomu Saitoh; Masumi Asanae, both of Kumagaya, Japan

[73] Assignee: Hitachi Metals, Ltd., Japan

[21] Appl. No.: 467,515

[22] Filed: Jun. 7, 1995

Related U.S. Application Data

[63] Continuation of Ser. No. 140,459, Oct. 25, 1993, abandoned.

[30] Foreign Application Priority Data

Oct. 26, 1992 [JP] Japan ..... 4-287407
Nov. 13, 1992 [JP] Japan ..... 4-327580

[51] Int. Cl.[6] ..... G03G 9/107; G03G 9/113

[52] U.S. Cl. ..... 430/106.6; 430/108; 430/111

[58] Field of Search ..... 430/106.6, 108, 430/111

[56] References Cited

U.S. PATENT DOCUMENTS 3,996,392 12/1976 Berg et al. ..... 428/407
5,256,513 10/1993 Kawamura et al. ..... 430/108 X
5,346,791 9/1994 Ozawa et al. ..... 430/106.6

FOREIGN PATENT DOCUMENTS 5-150538 6/1893 Japan .
182759 8/1987 Japan ..... 430/108
2-210365 8/1990 Japan .
219063 8/1990 Japan ..... 430/108
5-150558 6/1993 Japan .

*Primary Examiner*—Roland Martin
*Attorney, Agent, or Firm*—Finnegan, Henderson, Farabow, Garrett & Dunner

[57] ABSTRACT

A carrier for the developer of electrostatic latent images which is designed to reduce the fouling of the photosensitive member in the developer unit and to lower the volume resistivity of the carrier. This object is achieved by covering the resin-coated carrier with carbon black having a pH value lower than 7 and an average particle diameter smaller than 16 nm. The object is also achieved by covering the resin-bonded carrier with carbon black having a pH value higher than 7.5, if the carrier is to be mixed with a negatively charged toner, or having a pH value lower than 7, if the carrier is to be mixed with a positively charged toner, such that the carrier has a volume resistivity in the range of $10^1$ to $10^4$ Ω-cm.

4 Claims, 1 Drawing Sheet

CARRIER FOR DEVELOPER OF ELECTROSTATIC LATENT IMAGES

This application is a continuation of application Ser. No. 08/140,459 filed Oct. 25, 1993, now abandoned.

BACKGROUND OF THE INVENTION

1. Field of the Invention

The present invention relates to a carrier for the two-component developer composing of a toner and a carrier, which is used for developing an electrostatic latest image.

2. Description of the Prior Art

The two-component developer composed of a toner and a carrier has long been used for development of the electrostatic latent image formed on the surface of a photosensitive member. The carrier for magnetic brush development is magnetic powder which is available in varied forms. Typical ones are a resin-coated carrier (in which the surface of the carrier is coated with a resin) and a resin-bonded carrier (consisting of a resin and a particulate magnetic substance such as magnetite particles dispersed therein).

The recent magnetic carrier includes iron powder and ferrite powder (see U.S. Pat. No. 3,996,392). The latter has characteristic properties because ferrite is a sintered body of an oxide of trivalent iron and an oxide of a monovalent or divalent metal (such as barium, nickel, zinc, and copper) which varies in properties depending on composition and sintering conditions.

Being a sintered body of oxides, ferrite has a high resistance. The ferrite carrier used for development of electrostatic latent images usually has a resistance in the range of $10^5$ to $10^{14}$ Ω-cm. This resistance permits the toner (contact with the carrier) to acquire as much charge as 20–30 μc/g (in absolute value). A disadvantage of ferrite carrier is that it decreases or increases in resistance as the operating conditions change. Decrease in resistance results in the carrier sticking to the surface of the photosensitive member. Increase in resistance results in the image density decreasing. Moreover, the amount of charge the toner acquires varies depending on the operating conditions. If it increases, the sticking of carrier takes place; if it decreases, the image density increases. In other words, the image density varies depending on the operating conditions.

The recent development in electrophotography includes the back exposure method which, unlike the conventional complicated system using corona discharge, utilizes an electrophotographic system consisting of a glass transparent latent image support, a transparent electrode, a photosensitive member, and a light projecting head. It also includes the cleanerless image forming method which is designed to remove residual toner completely after image transfer so that the subsequent image is not affected. (This method is applied to laser printers and copying machines.) These new systems also use the two-component developer. Unfortunately, the existing one does not meet their requirements. The back exposure method needs a developer to inject as much charge into the photosensitive member as required for development. The high-speed copying machine needs a highly conductive carrier so that the photosensitive member is charged rapidly.

The present inventors' investigation revealed that the foregoing problem is solved if provisions are made so that the carrier has a resistance in the range of $10^2$–$10^5$ Ω-cm (which is lower than that of the conventional one) and the toner (in the form of developer) has a charge amount in the range of 5 to 20 μc/g (in absolute value). In fact, it was found that it is difficult to reduce the resistance of ferrite carrier below $10^5$ Ω-cm. The same is true of iron powder carrier. To cope with this situation, there has been proposed a carrier coated with a resin containing electrically conductive fine powder dispersed therein. This carrier has a controlled electrical resistance according to the amount of the electrically conductive fine powder. However, if the electrically conductive fine powder is carbon black, it is necessary to use it in a considerably large amount so as to reduce the resistance as required. To address this problem, there has been proposed a carrier coated with a resin and carbon black consecutively. (See Japanese Patent Laid-open No. 210365/1990.) This carrier has a reduced resistance with a less amount of carbon black. However, it suffers a disadvantage that carbon black is liable to fall from the carrier to foul the photosensitive member.

The conventional resin-bonded carrier has a high volume resistivity because the resin itself is electrically insulating. This produces undesirable effects (such as slow charging) when it is used for a high-speed machine (with the photosensitive drum rotating at a peripheral speed Vp faster than 150–200 mm/s). The result is uneven density in a solid image. Moreover, it is also subject to the operating conditions and hence it causes background fogging at a low temperature and humidity (say, 10° C. and 20% RH) and it gives a low image density at high temperature and humidity (say, 30° C. and 80% RH).

There has recently been proposed an electrically conductive carrier suitable for the developer to be used for the back exposure system. It is characterized by a resin coating on which is formed an electrically conductive layer of carbon black with a controlled average particle diameter. (See Japanese Patent Laid-open Nos. 150538/1993 and 150558/1993.) Controlling the average particle diameter of carbon black (or electrically conductive fine powder) relative to the average particle diameter of carrier is to prevent carbon black from falling from the carrier and to secure a uniform conductive passage on the surface of the carrier. However, the object of imparting conductivity to the carrier is not achieved as expected for carbon black of the same average particle diameter if the combination of a carrier with a toner is not adequate.

SUMMARY OF THE INVENTION

The present invention was completed to solve the above-mentioned problem. It is an object of the present invention to provide a carrier for the developer of electrostatic latent images which is less liable to foul the photosensitive member due to the falling of carbon black from the surface of the resin-coated carrier and which gives rise to an image whose density is affected only a little by the changing conditions.

It is another object of the present invention to provide a resin-bonded magnetic carrier whose surface is covered with electrically conductive carbon black so as to reduce the resistance of the carrier, to permit the toner to be charged rapidly, and to improve the image quality.

The first aspect of the present invention resides in a carrier for the developer of electrostatic latent images wherein the magnetic core is coated with a resin and the resin layer is covered with carbon black attached thereon, characterized in that the carbon black has a pH value lower than 7 and an average particle diameter smaller than 16 nm.

The resin coating layer may be made of any known resin such as fluoroplastic resin, silicone resin, styrene-acrylic resin, maleic alkyd resin, and acrylic resin, whose selection depends on its compatibility with the toner and its ability to be charged.

It was found that the carbon black as specified above is less liable to fall from the carrier and to foul the photosensitive member.

The core of the carrier should preferably be a particulate magnetic substance (such as iron powder, ferrite powder, and magnetite powder) having an average particle diameter of 10–150 μm , preferably 30–100 μm . Moreover, it should preferably have a high level of saturated magnetization (about 60–210 emu/g).

The coating of the magnetic core with a resin may be accomplished by any known process such as fluidized bed coating. The coating thickness varies depending on the use conditions. The attaching of carbon black to the resin-coated core may be accomplished by mixing in a mixer. The amount of carbon black should be determined according to the desired resistance of the carrier. It ranges from 0.1 to 4 parts by weight for 100 parts by weight of core if the desired resistance is $10^2$ to $10^5$ Ω-cm.

The second aspect of the present invention resides in a carrier for the developer of electrostatic latent images wherein the developer is composed of a carrier and a negatively charged toner, characterized in that the magnetic core is composed of a thermoplastic resin and a particulate magnetic substance and is covered with carbon black bonded thereto, said carbon black having a specific pH value such that the carrier has a volume resistivity of $10^1$ to $10^4$ Ω-cm.

The resin-bonded carrier has a volume resistivity as specified above so that it is highly conductive which leads to the improved development electrode effect, and photosensitive member becomes charged rapidly, It was found that it is possible to reduce the volume resistivity of the carrier by adding carbon black (as electrically conductive fine particles) to surface of the carrier and that there is a relationship between the pH value of the carbon black and the charging polarity of the toner to be combined with the carrier. In the case where the carrier is combined with a negatively charged toner, the carbon black should have a pH value higher than 7.5. In the case where the carrier is combined with a positively charged toner, the carbon black should have a pH value lower than 7. The carbon black with such a specific pH value effectively reduces the resistance of the carrier.

The particulate magnetic substance should preferably be used in an amount of 50–90 wt % (% by weight) for the resin so as to prevent carrier sticking and toner spent. The particulate magnetic substance may be selected from magnetite and ferrite, which has a particle diameter of 0.1—3 μm for dispersion into the carrier.

The magnetic particles should have an average particle diameter of 10–60 μm, preferably 20–50 μm. Excessively fine particles cause carrier sticking and excessively coarse particles are harmful to high resolution images.

The amount of carbon black should be 0.5–3.0 parts by weight for 100 parts by weight of the magnetic particles, so that the carrier has increased conductivity and provides stable images under varied use conditions.

The first aspect of the present invention produces the effect of preventing carbon black from falling from the carrier surface because the carbon black has a pH value lower than 7. Moreover, the use of magnetic particles having a high level of saturated magnetization offers several advantages such as strong "eating up", reduction in particle size, easy control of toner concentration, and great reduction in carrier sticking.

The second aspect of the present invention produces the effect of not damaging the photosensitive drum because the fine particles of magnetic substance is surrounded by a resin. The resin-bonded carrier has a volume resistivity as low as $10^1$–$10^4$ Ω-cm because it is covered with electrically conductive carbon black which has a specific pH value selected according to the charging polarity of the toner. The low resistance leads to improved conductivity and rapid charging. This is advantageous to a high-speed machine and produces the development electrode effect which contributes to quality images free of density variation in solid parts.

DESCRIPTION OF THE PREFERRED EMBODIMENTS

EXAMPLE 1

Figure 1:
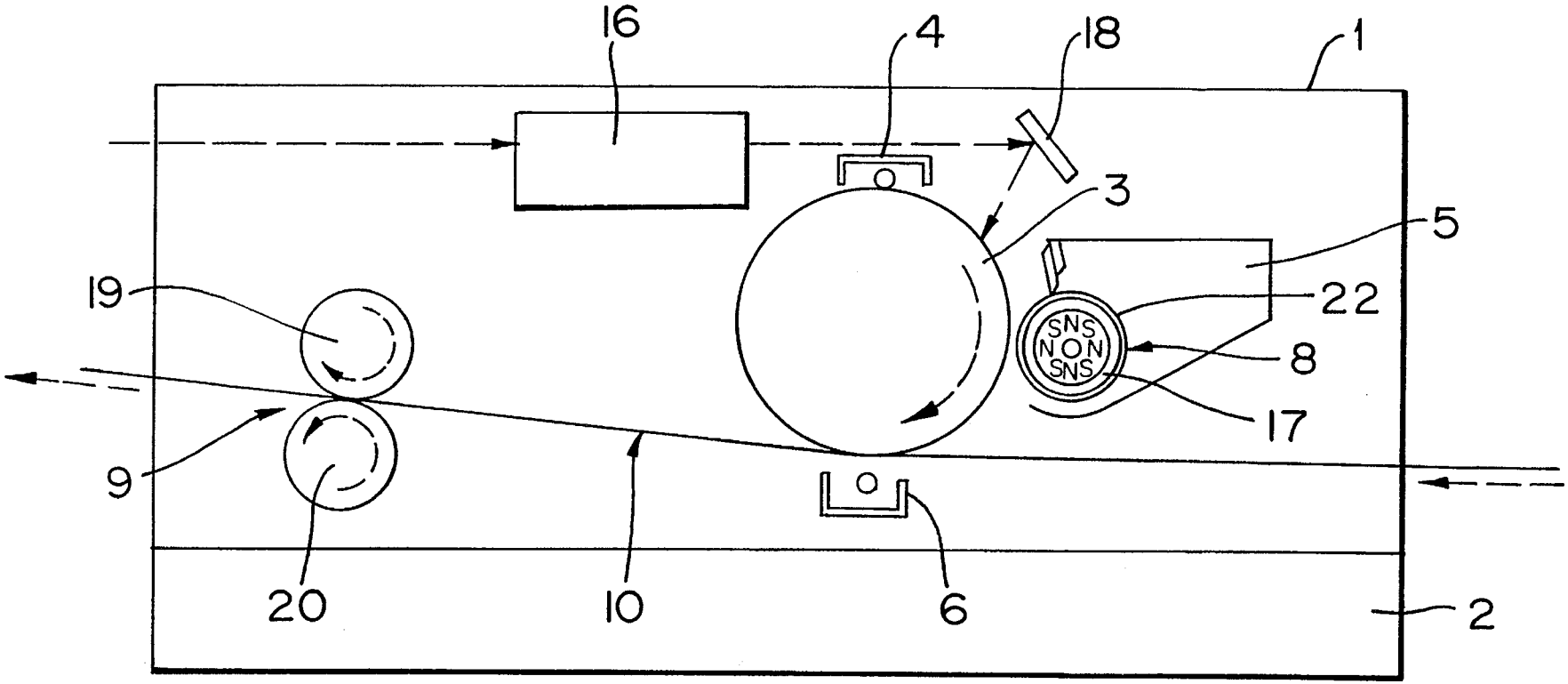
FIG. 1 is a schematic representation showing the image forming apparatus used in the examples of the present invention.

A carrier pertaining to the present invention was prepared by coating 100 parts by weight of ferrite particles ("KBN 100" from Hitachi Metals, with a particle diameter of 37–105μm and an average particle diameter of 70 μm) with 7.5 parts by weight of silicone type resin ("SR 2410"from Toray Silicone) by fluidized bed coating and further bonding to the coating surface 1 part by weight of carbon black ("#2650" from Mitsubishi Chemical Industries, having an average particle diameter of 13 nm and a pH value of 6.5) using a super mixer. The thus prepared carrier was mixed with a toner ("HMT 433" from Hitachi Metals) in an amount of 20 wt % for 10 minutes to give a developer. The developer was used for continuous printing of 100,000 copies under the following conditions at 20° C. and 60% RH (normal temperature, normal humidity), 10° C. and 20% RH (low temperature, low humidity), and 35° C. and 80% RH (high temperature, high humidity).

Image forming conditions:

Peripheral speed of the OPC drum: 60 mm/sec

Surface electric potential: −550 V

Magnet roll: a sleeve (made of SUS304) 20 mm in outside diameter, containing an 8-pole cylindrical magnet (700 G of magnetic flux density on the sleeve), rotating at 150 rpm.

Developing gap: 0.4 mm

Doctor gap: 0.3 mm

Bias voltage to the sleeve: −500 V for reversal development

Transfer of toner images to plain paper: by corona Fixing by the heating roll: at 160° C. and a linear pressure of 1 kg/cm.

To measure resistance, a small sample (10-odd mg) of the carrier was packed in a teflon® tube (3.05 mm in inside diameter) under a load of 0.1 kg. With an electric field of 100 V (DC) applied to the sample, the resistance was measured using an insulation resistance tester, Model 4329, made by Yokogawa Hewlett Packard.

Comparative Example 1

A developer was prepared in the same manner as in Example 1, except that carbon black was excluded. Using this developer, continuous printing of 100,000 copies was carried out in the same manner way as in Example 1. The electric resistance of the carrier was measured in the same manner as in Example 1.

The results in Examples 1 to 3 and Comparative Examples 1 and 2 are shown in Table 1.

TABLE 1

| | Coating resin and pH value of carbon black | Average particle diameter of carbon black and fouling of photosensitive member by carbon black | Density of solid image and electric resistance of carrier (Ω-cm) Normal temperature, normal humidity | Low temperature, low humidity | High temperature, high humidity |
|---|---|---|---|---|---|
| Example 1 | Silicone resin, pH 6.5 | 13 nm, very little fouling | 1.35 up<br>$6.7 \times 10^2$ | 1.33 up<br>$9.5 \times 10^2$ | 1.30 up<br>$8.0 \times 10^2$ |
| Comparative Example 1 | Silicone resin, no carbon black | 13 nm, | 1.35 up<br>$2.7 \times 10^{11}$ | 1.12<br>$8.9 \times 10^{11}$ | 0.95<br>$3.1 \times 10^{12}$ |
| Comparative Example 2 | Silicone resin, pH 7.5 | 18 nm, the photosensitive member was fouled with carbon black and the image was adversely affected. | | | |
| Example 2 | Styrene-acrylic resin, pH 6.5 | 13 nm, very little fouling | 1.36 up<br>$6.0 \times 10^2$ | 1.33 up<br>$7.2 \times 10^2$ | 1.32 up<br>$7.4 \times 10^2$ |
| Example 3 | Fluoroplastic resin, pH 6.5 | 13 nm, very little fouling | 1.35 up<br>$5.9 \times 10^2$ | 1.34 up<br>$6.4 \times 10^2$ | 1.35 up<br>$9.2 \times 10^2$ |

Comparative Example 2

A developer was prepared in the same manner as in Example 1, except that the carbon black was replaced by another one ("MA 600" from Mitsubishi Chemical Industries, having a pH value 7.5 and an average particle diameter of 18 nm). Using this developer, continuous printing of 100,000 copies was carried out in the same manner as in Example 1. The developer fouled the photosensitive member and hence gave rise to poor images.

EXAMPLE 2

A carrier pertaining to the present invention was prepared by coating 100 parts by weight of ferrite particles having an average particle diameter of 70 μm (the same one as used in Example 1) with 1.5 parts by weight of styrene-acrylic resin ("TB 1804" from Sanyo Chemical Industries) dissolved in 3.5 parts by weight of toluene by fluidized bed coating and further bonding to the coating surface 1 part by weight of carbon black (the same one as used in Example 1) using a super mixer. The thus prepared carrier was mixed with a toner ("HMT 433" from Hitachi Metals) in an amount of 20 wt % for 10 minutes to give a developer. The developer was used for continuous printing of 100,000 copies under the same conditions as in Example 1. The electric resistance of the carrier was measured in the same manner as in Example 1.

EXAMPLE 3

A carrier pertaining to the present invention was prepared by coating 100 parts by weight of ferrite particles having an average particle diameter of 70 μm (the same one as used in Example 1) with 7.5 parts by weight of fluoroplastic resin ("FM300EM" from Daikin Industries) by fluidized bed coating and further bonding to the coating surface 1 part by weight of carbon black (the same one as used in Example 1) using a super mixer. The thus prepared carrier was mixed with a toner ("HMT 439" from Hitachi Metals) in an amount of 20 wt % for 10 minutes to give a developer. The developer was used for continuous printing of 100,000 copies under the same conditions as in Example 1. The electric resistance of the carrier was measured in the same manner as in Example 1.

It is noted from Table 1 that the carbon black having a pH value of 6.5 gives a density higher than 1.30 for the solid image at any temperature and humidity regardless of the kind of coating resin. By contrast, the carrier without carbon black in Comparative Example 1 caused variation in image density depending on temperature and humidity. (In other words, the image density higher than 1.35 at normal temperature and normal humidity decreased to 1.12 and 0.95 at low temperature and low humidity and at high temperature and high humidity, respectively.)

It is also noted from Table 1 that the image density depends on the electric resistance of the carrier. That is, the electric resistance of the carrier in Examples 1 to 3 is of the order of $10^2$, whereas that in Comparative Example 1 is of the order of $10^{11}$ or $10^{12}$.

It is also noted that very little fouling of the photosensitive member with carbon black falling from the carrier occurred in Examples 1 to 3, whereas it occurred, aggravating images, in Comparative Example 2.

Incidentally, in the fourth to sixth columns of Table 1, the upper line indicates the image density and the lower line, the electric resistance of the carrier.

EXAMPLE 4

A carrier (sample No. 4-1) was prepared in the same manner as in Example 1, except that the ferrite powder was replaced by iron powder (having an average particle diameter of 30 μm, and $\sigma_s$=190 emu/g).

A carrier (sample No. 4-2) was prepared in the same manner as in Example 2, except that the ferrite powder was replaced by magnetite powder (having an average particle diameter of 20 μm,$\sigma_s$=80 emu/g).

Each carrier was mixed with a magnetic toner ("HMT 450" from Hitachi Metals) to give a developer containing 20 wt % toner. For evaluation, the developer was used to produce images using an apparatus shown in FIG. 1.

The image-forming unit 1 shown in FIG. 1 consists of a controller 2, a photosensitive drum 3, a corona charger 4, a laser scanner 16 for exposure, a developing unit 5, and a corona transfer unit 6.

The surface of the photosensitive drum 3, which rotates at a fixed peripheral speed, is uniformly charged by the corona charger 4. The laser scanner 16 inputs the electric signals corresponding to the image information. The laser beam from the laser scanner 16 impinges upon the surface of the photosensitive drum 3 after reflection by the mirror 18. Exposure by the laser beam forms an electrostatic latent image corresponding to the image information.

The developing unit 5 contains the magnet roll 8 and the sleeve 22 which rotates around the magnet roll 8. As a bias voltage is applied to the sleeve 22 from an external electric source, a magnetic brush of developer (in thin layer) is formed. This magnetic brush rubs against the surface of the photosensitive drum 3 to make tile electrostatic latent image visible. The thus developed toner image is transferred to recording paper by the corona transfer unit. The recording paper carrying a toner image is forwarded to the fixing unit 9, in which it is heated under pressure between the heating roll 19 and the pressure roll 20. After transfer, the toner remaining on the photosensitive drum is removed and recovered by the magnetic brush in the subsequent development step.

The image forming and development were carried out at normal temperature and normal humidity using the above-mentioned apparatus by rotating the OPC drum 3 at a peripheral speed ($V_{p1}$) of 60 mm/sec. uniformly charging the OPC drum to −550 V by means of the corona charger 4, forming an electrostatic latent image by exposure, rotating the sleeve (made of SUS304) 22 at 150 rpm (with an 8-pole permanent magnet for 700 G on the sleeve surface), applying a bias voltage (−500 V) to the sleeve, while maintaining a doctor gap of 0.4 mm and a developing gap of 0.3 mm for reversal development, transferring the toner image to plain paper by the corona transfer unit 5, and fixing the transferred image by the heating roll at 160° C. and a linear pressure of 1 kg/cm. The toner remaining on the photosensitive drum after transfer is recovered by the magnetic brush formed on the sleeve 22 in the developer unit. The results of evaluation of images are shown in Table 2.

It is noted from Table 2 that the carriers (4-1 and 4-2) having a high value of $\sigma_s$ provide a high-quality image without attaching.

TABLE 2

| Carrier ($\sigma_s$) | Image density | Resolution (per mm) | Attaching of carrier to OPC drum |
|---|---|---|---|
| 4-1 (190 emu/g) | 1.38 | 8 | none |
| 4-2 (80 emu/g) | 1.41 | 8 | none |
| Example 1 (55 emu/g) | 1.45 | 8 | little |

EXAMPLE 5

In this example, the particulate magnetic substance is magnetite ("EPT 500" from Toda Kogyo Co., Ltd.) and the thermoplastic resin is styrene-n-butyl methacrylate copolymer (having a weight-average molecular weight of 230000 and a number-average molecular weight of 10000). 60 parts by weight of magnetite was dry-blended with 40 parts by weight of styrene-n-butylmethacrylate using a mixer. The mixture was kneaded with heating and then solidified on cooling. The resulting solid was pulverized by wet process using a ball mill. The resulting slurry was spray-dried at 120° C., followed by classification. Thus there were obtained magnetic particles having an average particle diameter of 30 μm.

The thus obtained composition may optionally be incorporated with a charge controlling agent (such as nigrosine dye and metal-containing dye) and a fluidizing agent (such as silica and alumina).

In this example, the electrically conductive fine powder is carbon black ("#2650" with pH 6.5, from Mitsubishi Chemical Industries). This carbon black in an amount from 0 to 4.0 parts by weight was mixed with the above-mentioned magnetic particles using a super mixer. Thus there was obtained a resin-bonded magnetic carrier whose surface is covered with carbon black. Incidentally, the magnetic particles without carbon black had a volume resistivity of $2\times 10^{15}$ 106 -cm. Measurement was performed by packing the sample (10-odd mg) into a teflon® cylinder (3.05 mm in inside diameter) under a load of 0.1 kg and applying a dc electric field of 200 V/cm.

In this example, the carbon black is one which has a pH value of 6.5. However, it is desirable to use carbon black with pH≦7 for the positively charged toner and to use carbon black with pH>7.5 for the negatively charged toner.

In this example, the toner was prepared from 86 parts by weight of styrene-n-butyl methacrylate copolymer (having a weight-average molecular weight of 210000 and a number-average molecular weight of 16000), 3 parts by weight of polypropylene (from Sanyo Chemical Industries), and 10 parts by weight of carbon black ("#44" from Mitsubishi Chemical Industries) by dry-blending, followed by kneading, solidifying on cooling, crushing, and classification. The resulting toner has an average particle diameter of 10 μm. This toner was mixed with the above-mentioned carrier to give a two-component developer containing 3 wt % toner.

Using this two-component developer, the relationship among the amount of carbon black in the carrier, the resistance of the carrier, and the image quality was investigated. The results are shown in Table 3. Incidentally, the image forming and development were carried out by running the OPC drum (negatively charged) at a peripheral speed of 200 mm/sec, charging the OPC drum to −550 V by means of the corona charger, rotating the developer sleeve (20 mm in diameter, made of SUS304) at 150 rpm (with a built-in 4-pole magnet for magnet flux density of 700 G on the sleeve surface), applying a bias voltage (−500 V) to the sleeve, while maintaining a doctor gap of 0.6 mm and a developer gap of 0.8 mm, and fixing with a heating roll at 180° C. and at a linear pressure of 1 kg/cm.

TABLE 3

| Amount of | Resistance | Normal temperature, normal humidity | Low temperature, low humidity | | High temperature, high humidity | |
|---|---|---|---|---|---|---|
| carbon black (parts by weight) | of carrier (Ω-cm) | Uniformity of solid image | Image density | Background fogging | Image density | Background fogging |
| 0 | $2\times 10^{15}$ | NG | 0.93 | NG | 1.22 | NG |

TABLE 3-continued

| Amount of carbon black (parts by weight) | Resistance of carrier (Ω-cm) | Normal temperature, normal humidity: Uniformity of solid image | Low temperature, low humidity: Image density | Low temperature, low humidity: Background fogging | High temperature, high humidity: Image density | High temperature, high humidity: Background fogging |
|---|---|---|---|---|---|---|
| 0.5 | $8 \times 10^3$ | OK | 1.32 | OK | 1.40 | OK |
| 1.0 | $4 \times 10^3$ | OK | 1.41 | OK | 1.43 | OK |
| 2.0 | $2 \times 10^3$ | OK | 1.43 | OK | 1.44 | OK |
| 3.0 | $6 \times 10^2$ | OK | 1.45 | OK | 1.45 | OK |
| 4.0 | $1 \times 10^2$ | OK | 1.51 | OK | 1.50 | NG |

In Table 3, normal temperature and normal humidity mean 20° C. and 60% RH, low temperature and low humidity mean 10° C. and 20% RH, and high temperature and high humidity mean 35° C. and 80% RH.

It is noted from Table 3 that the resin-bonded carrier has improved conductivity when the amount of carbon black is in the range of 0.5 to 0.3 parts by weight. In addition, it provides uniform solid images under any use conditions.

EXAMPLE 6

In this example, the particulate magnetic substance is magnetite ("EPT 500" from Toda Kogyo Co., Ltd.) and the thermoplastic resin is polyester resin (having a weight-average molecular weight of 150000 and a number-average molecular weight of 6000). 30 to 95 parts by weight of magnetite was mixed with 70 to 5 parts by weight of polyester resin by dry blending, followed by kneading, solidifying on cooling, pulverizing, spray drying at 120° C., and classification. Thus there were obtained several kinds of resin-bonded carriers having an average particle diameter of 50 μm.

The thus obtained resin-bonded carrier was dry-blended with 1.5 parts by weight of carbon black ("MA 600" with pH 7.5, from Mitsubishi Chemical Industries) as the electrically conductive fine powder (the same one as used in Example 5), using a super mixer. Thus there was obtained a resin-bonded magnetic carrier whose surface is covered with carbon black. The resulting resin-bonded carrier had a volume resistivity of $5\times10^3$ Ω-cm (measured in tile same manner as in Example 1).

In this example, a magnetic toner was prepared from 50 parts by weight of styrene-n-butyl methacrylate copolymer (having a weight-average molecular weight of 210000 and a number-average molecular weight of 16000), 45 parts by weight of magnetite ("EPT 500" from Toda Kogyo Co., Ltd.), 3 parts by weight of polypropylene ("Viskol 550P" from Sanyo Chemical Industries), and 2 parts by weight of Cr-containing azo dye ("Bontron #3120" from Orient Kagaku Co., Ltd.) by dry-blending, followed by kneading, solidifying on cooling, crushing, and classification. The resulting magnetic toner had an average particle diameter of 11 μm. This toner was mixed with the above-mentioned resin-bonded carrier to give a two-component developer containing 40 wt % toner.

Using this two-component developer, the relationship among the amount of magnetite in the carrier, the sticking of the carrier, the loss of the carrier, and the image quality was investigated. The results are shown in Table 4. Incidentally, the image forming and development were carried out by running the OPC drum (positively charged) at a peripheral speed of 200 mm/sec, charging the OPC drum to +550 V by means of the corona charger, rotating the developer sleeve (20 mm in diameter, made of SUS304) at 150 rpm (with a built-in 4-pole magnet for 700 G on the sleeve surface), applying a bias voltage (+500 V) to the sleeve, while maintaining a doctor gap of 0.3 mm and a developer gap of 0.4 mm, and fixing (after corona transfer) with a heating roll at 180° C. and at a linear pressure of 1 kg/cm.

TABLE 4

| Amount of magnetite (wt %) | Image density | attaching of carrier | Spent of toner |
|---|---|---|---|
| 30 | 1.20 | yes | no |
| 50 | 1.41 | no | no |
| 80 | 1.48 | no | no |
| 90 | 1.51 | no | no |
| 95 | 1.50 | no | yes |

It is noted from Table 4 that the amount of magnetite in the carrier should preferably be 50–90 wt % of the amount of resin. With an amount of magnetite less than 50 wt %, there is a strong tendency to carrier attaching because of the less magnetic power of the resin-bonded carrier. With an amount of magnetite more than 90 wt % (and hence a smaller amount of resin), there is a strong tendency to spent of toner due to the irregular surface of the carrier which catches the toner.

Although the invention has been described in its preferred form with a certain degree of particularity, it is understood that the present disclosure may be modified without departing from the spirit and scope thereof by changing the carrier core and coating resin and the combination with a toner.

The carrier of the present invention permits production of high-quality copies without causing carrier sticking and fouling the photosensitive member with carbon black falling from the carrier.

In addition, owing to carbon black with a specific pH value as the conductive fine particles on the surface of the magnetic particles, the resin-bonded carrier of the present invention has good conductivity, with a volume resistance as low as $10^1$–$10^4$ Ω-cm. Therefore, the resin-bonded carrier is charged rapidly, which contributes to the production of uniform solid images regardless of use conditions (temperature and humidity).

What is claimed is:

1. A carrier for the developer of electrostatic latent images comprising a magnetic core coated with a resin layer, the resin layer being covered with carbon black bonded thereto, wherein the carbon black has a pH value lower than 7 and an average particle diameter smaller than 16 nm.

2. A carrier for the developer of electrostatic latent images wherein the developer is composed of a carrier and a negatively charged toner, wherein said carrier comprises a magnetic core comprising a thermoplastic resin and a particulate ferromagnetic substance and said magnetic core is covered with carbon black attached thereon, the amount of said particulate ferromagnetic substance is 50 to 90 wt % for 100 wt % of the resin; and said carbon black having a pH value higher than 7.5 such that the carrier has a volume resistivity of $10^1$ to $10^4$ Ω-cm, and the amount of said carbon black is 0.5 to 3.0 parts by weight for 100 parts by weight of the magnetic core.

3. A carrier for the developer of electrostatic latent images wherein the developer is composed of a carrier and a positively charged toner, wherein said carrier comprises a magnetic core comprising a thermoplastic resin and a particulate ferromagnetic substance and said magnetic core is covered with carbon black attached thereon, the amount of said particulate ferromagnetic substance is 50 to 90 wt % for 100 wt % of the resin; and said carbon black having a pH value lower than 7 such that the carrier has a volume resistivity of $10^1$ to $10^4$ Ω-cm, and the amount of said carbon black is 0.5 to 3.0 parts by weight for 100 parts by weight of the magnetic core.

4. A carrier for the developer of electrostatic latent images as claimed in claim 1, wherein the amount of carbon black ranges from 0.1 to 4 parts by weight for 100 parts by weight of the resin coated core.

* * * * *